United States Patent [19]

Ankeny et al.

[11] 4,023,000

[45] May 10, 1977

[54] DIRECT DRIVE SLIDING CONTACT TRANSDUCER

[75] Inventors: Claude C. Ankeny; Dean E. Gladow; Charles E. Wierzbicki, all of Albuquerque, N. Mex.

[73] Assignee: Sparton Corporation, Jackson, Mich.

[22] Filed: Sept. 2, 1975

[21] Appl. No.: 609,232

[52] U.S. Cl. ..... 200/83 C; 73/398 AR; 338/41

[51] Int. Cl.[2] ..... H01H 35/32

[58] Field of Search ..... 200/83 C, 83 RS, 81 R, 200/81.4, 153 B; 73/398 AR; 338/41, 194, 42

[56] References Cited

UNITED STATES PATENTS

| | | | |
|---|---|---|---|
| 3,046,369 | 7/1962 | Hicks | 200/83 C |
| 3,136,970 | 6/1964 | Pegram | 73/398 A |
| 3,283,283 | 11/1966 | Denner | 338/41 |

*Primary Examiner*—Gerald P. Tolin
*Attorney, Agent, or Firm*—Beaman & Beaman

[57] ABSTRACT

The invention pertains to a pressure sensing transducer employing an evacuated bellows wherein sliding electric contacts are mounted upon the bellows' movable portion. The sliding contacts traverse over a printed circuit board having conducting portions defined thereon connected to electrical resistances whereby pressure variations imposed upon the bellows position the contacts upon the conducting portions to produce an electric signal. A variety of adjusting means are utilized to adjust the position of the printed circuit board to the bellows, and the "span" of the conducting portions in the direction of contact movement is selectively varied by forming the conducting portions of a wedge shape and laterally adjusting the printed circuit board. Further, in an embodiment of the invention, zero reference points are defined on the printed circuit board when used in conjunction with a pair of laterally spaced contacts to electrically indicate the orientation of the printed circuit board to the bellows and bellows mounted contacts when initially calibrating the transducer.

11 Claims, 15 Drawing Figures

DIRECT DRIVE SLIDING CONTACT TRANSDUCER

BACKGROUND OF THE INVENTION

The invention pertains to pressure sensing transducers utilizing a bellows and electric sliding contacts to selectively vary an electrical resistance in accord with the pressure sensed.

Pressure sensing transducers basically employ pressure sensing means capable of producing mechanical movement under the influence of the pressure being sensed, and this mechanical movement is converted into electric signals. Typical transducer devices employ bellows, Bourdon tubes, diaphragms, bimetal elements and other structure to sense the pressure while piezoelectric crystals, mercury and reed switches, potentiometers and other sliding contact resistance elements have been used to sense and indicate the movement of the pressure sensing device and convert such mechanical movement into an electric signal.

One sensitive transducer utilized to sense fluctuations, such as atmospheric, gas and fluid pressures, employs a flexible wall bellows, usually evacuated, which changes length in accord with the degree of pressure imposed upon the bellows by the surrounding medium. The condition of the bellows, i.e., the length thereof, is sensed by a sliding contact type device which is capable of varying its electrical resistance in accord with the relative condition of the bellows. For instance, the bellows may be connected to a potentiometer type device which varies resistance in accord with the position of the tap and the length of the resistance wire utilized in the circuit for a given potentiometer setting.

Transducer devices of the prior art utilizing sliding contacts have, in the past, employed motion magnification means between the switch contacts and the bellows in order to amplify the switch contact movement. Such amplification means commonly take the form of fulcrumed lever devices wherein a small movement of the bellows results in a considerably greater movement of the contact of the switch over the electric resistance member. Such devices have the disadvantage of inaccuracies due to the multiplication of movement, and wear and manufacturing tolerances in the moving parts. Further, such devices are relatively complex and expensive to manufacture, and are relatively bulky in size due to the plurality of components required. In the past, a direct connection between the bellows and the sliding contacts in a low tolerance transducer was not considered practical in view of the relatively limited bellows movement and the difficulty in orienting, calibrating and maintaining the desired relationships between the sliding contacts driven by the bellows and the resistance elements over which the contacts moved.

SUMMARY OF THE INVENTION

An object of the invention is to produce a bellows-operated transducer having sliding electrical contacts directly connected to the bellows whereby motion multiplication mechanisms are eliminated.

An additional object of the invention is to provide a transducer utilizing a bellows and of the sliding contact type wherein calibration between the bellows contacts and the conductors engaged by the contacts may be readily achieved exterior of the transducer housing.

A further object of the invention is to provide a sliding contact type transducer wherein contacts traverse a printed circuit board having conducting portions defined thereon. The "span" of the conducting portions is readily varied by a lateral displacement of the conducting portions relative to the contacts by varying the width of the conducting portions in a lateral direction, the configuration of the conducting portions preferably being wedge-like.

Another object of the invention is to provide a sliding contact transducer utilizing a pair of contacts wherein initial calibration and orientation of the contacts with conducting portions defined upon a printed circuit board is facilitated by the provision of a pair of electrical reference points laterally spaced with respect to each other defined upon the printed circuit board and defined by conducting and nonconducting portions thereon.

In the practice of the invention an evacuated flexible wall bellows in mounted within a casing. Electrical contacts adapted to slidably tranverse over conducting portions defined on a printed circuit board are directly mechanically connected to the bellows for movement with the movable portion of the bellows. Means are defined for relatively adjusting the contacts relative to the printed circuit board for calibration purposes, and such means include affixing the circuit board relative to the transducer case and movably mounting the bellows with respect to the case without rotation, fixing the circuit board relative to the case and threadedly mounting the bellows to the case for rotation thereto and attendant longitudinal displacement in the direction of bellows expansion under pressure fluctuations, and fixing the bellows with respect to the case and translating the circuit board in a direction parallel to the bellows movement.

One end of the bellows is fixed with respect to the casing, after the initial adjustment between the bellows and casing is achieved, and the other end of the bellows moves in accordance with the degree of the pressure being sensed. The sliding contacts are affixed to the movable bellows portion for movement therewith and translation over the conducting portions of the printing circuit board. The conducting portions are in an electrical circuit with resistors, and the conducting portions are of a wedge configuration with respect to the lateral circuit board orientation such that lateral shifting of the circuit board relative to the direction of contact movement varies the dimension of the conducting portion in alignment with its associated contact thereby permitting adjustment of the"span" of the transducer. The printed circuit board is adjustably mounted upon its associated support for movement transverse to the direction of bellows and contact movement in order to provide adjustment of the "span."

Proper orientation of the printed circuit board relative to the sliding contacts is achieved by initially orienting the contacts and printed circuit board ny use of "zero" reference points defined upon the circuit board. Such reference points are defined by conducting and nonconducting portions of the circuit board laterally spaced with respect to each other relative to the direction of contact movement. A pair of bellows-operated spaced contacts each engage a reference point at the desired orientation between the circuit board and bellows and, thus, the transducer may be electrically oriented and calibrated very accurately with a minimum of effort.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS.

Figure 10:
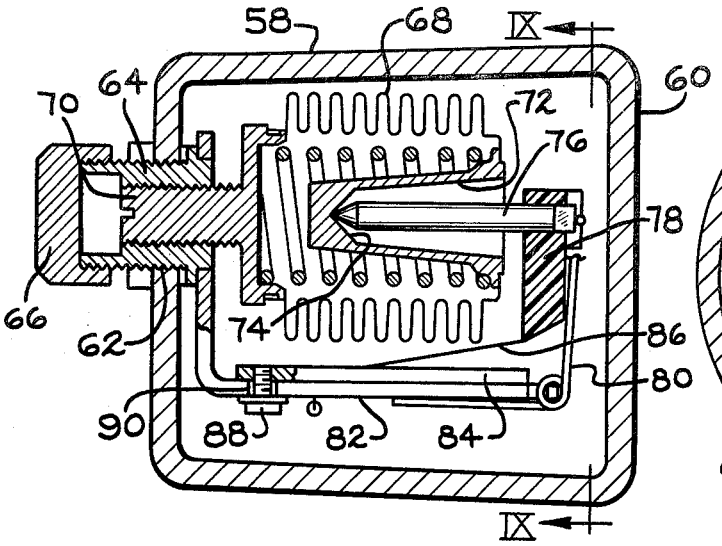
FIG. 10 is a diametrical elevational sectional view of the transducer embodiment taken along section X—X of FIG. 9.
Figure 9:
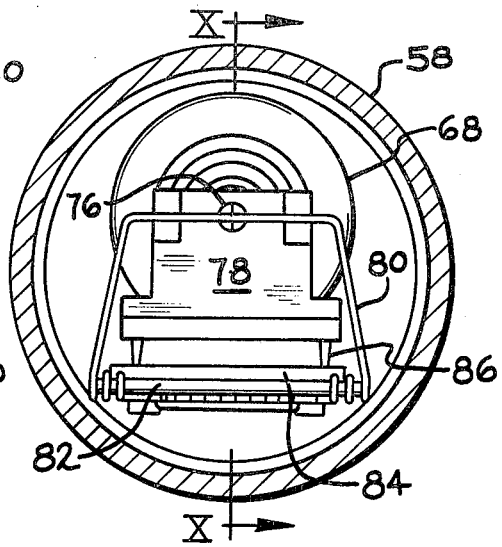
FIG. 9 is an elevational sectional view of another embodiment of transducer as taken along section IX—IX of FIG. 10.

FIGS. 1 through 8 illustrate an embodiment of transducer constructed in accord with the invention of a "long" form wherein the relationship of components permits the transducer to be of a relatively concise diameter, but of a relatively long length. The embodiment of FIGS. 9 and 10 is of a "short" configuration wherein the overall length of the transducer is reduced as compared to the embodiment of FIGS. 1 through 8, but the diameter of the transducer casing is greater when the same size bellows is employed. The embodiment of FIGS. 12 through 15 is also of a "short" configuration, and a specialized housing is illustrated.

With reference to FIGS. 1 through 8, the basic components of a transducer in accord with the invention concept will be appreciated. The transducer includes a circular base 10 provided with a circular grooved periphery for sealing cooperation with the cylindrical casing 12. The base is centrally threaded at 14 for reception of the bellows adjustment screw 16, as will be later described. The printed circuit board support 18 takes the form of a partially cylindrical extension welded or soldered to the base 10 and extending in a direction parallel to the axis of the base. The support 18 includes folded portions 20, FIG. 6, which form a planar supporting surface for the printed circuit board 22, and receive the circuit board mounting screws, as later described. The base is also provided with a larger concentrically threaded opening 24 for receiving a cap or plug, not shown.

The casing 12 tightly fits upon the base 10 in engagement with the O-ring 26, and at the right end a pair of terminals 28 extend therethrough for connection to electrical apparatus capable of interpreting and recording the transducer output.

Figure 2:
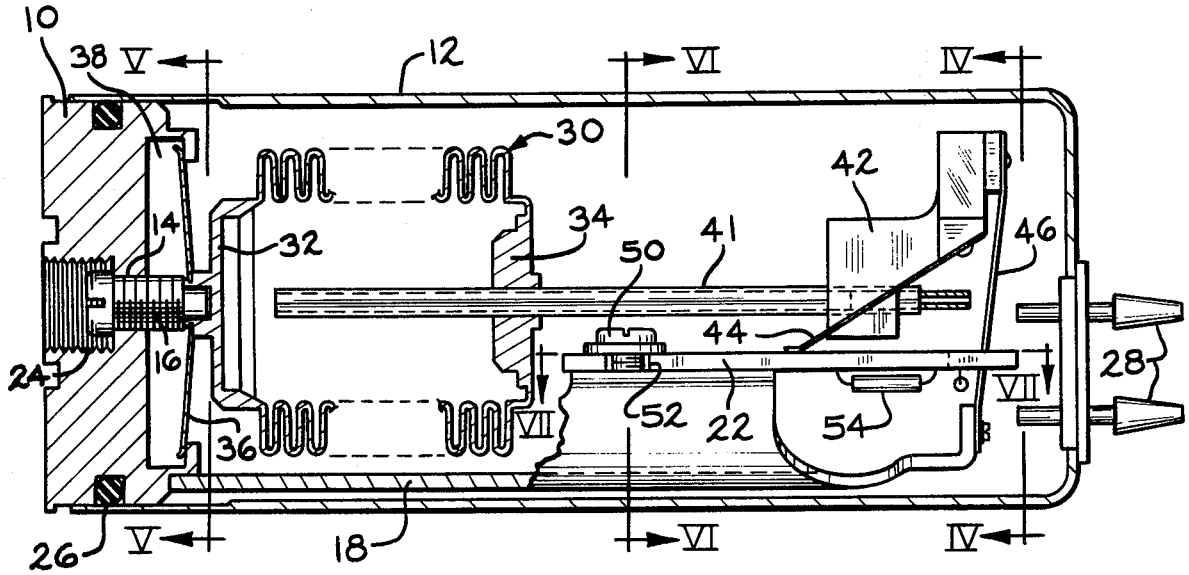
FIG. 2 is a diametrical elevational sectional view of the transducer of FIG. 1 illustrating the casing housing in position.
Figure 5:
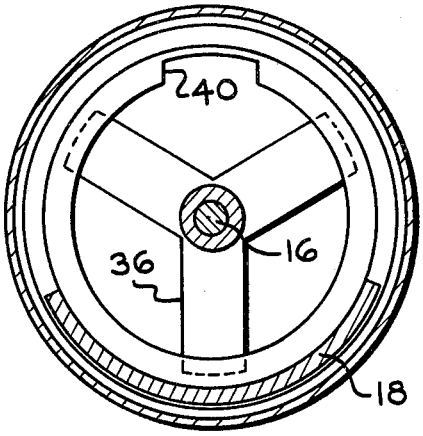
FIG. 5 is an elevational sectional view of the bellows spring as taken along section V—V of FIG. 2.

A bellows 30 is mounted to the base 10 by means of the adjustment screw 16, FIG. 2. The bellows is usually evacuated and includes a flexible wall, a base end 32 and a movable end 34. The bellows base end 32 includes a hub to which the three-legged left spring 36, FIG. 5, is attached. The spring is received within a circular groove 38 defined in the base 10, and the spring is assembled therein by alignment of a leg with the notch 40, FIG. 5. The spring axially biases the bellows and the screw 16 is received within the bellows hub for rotation therein but is prevented from axial movement thereto and, in this manner, any play that exists in the screw is compensated for by the spring and the bellows may be accurately located with respect to the base in the axial direction of the base.

A contact block supporting rod 41 is mounted within the bellows end 34 and exteriorly threaded for relative axial positioning with respect to the bellows end. The outer end of the rod supports a dielectric contact block 42 upon which four metal resilient sliding electrical wipers or contacts 44 are mounted. The contacts 44 are electrically interconnected and engage the upper surface of the printed circuit board 22 mounted upon the printed circuit support 18. The contact block 42 is supported against movement away from the printed circuit board by a flexible left 46 attached at its lower end, FIG. 2, to the end of support 18 by screws 48, and attached to the contact block at its upper end by pins. The left 46 permits the contact block 42 to move in a horizontal direction as viewed in FIG. 2, but prevents movement of the contact block away from the printed circuit board, thereby assuring a positive electrical path between the contacts 44 and the conducting portions defined on the printed circuit board.

Figure 6:
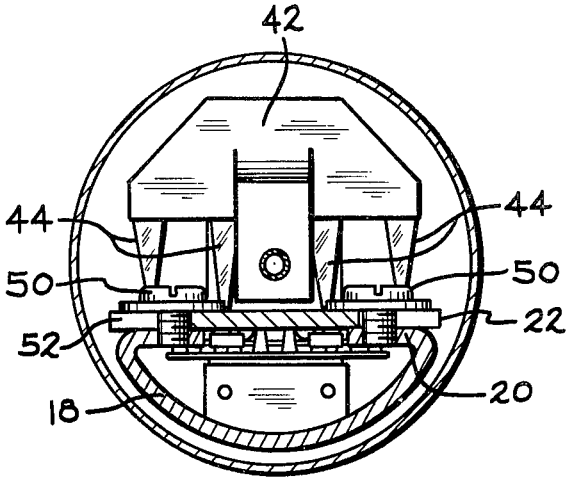
FIG. 6 is an elevational sectional view as taken along section VI—VI of FIG. 2.
Figure 3:
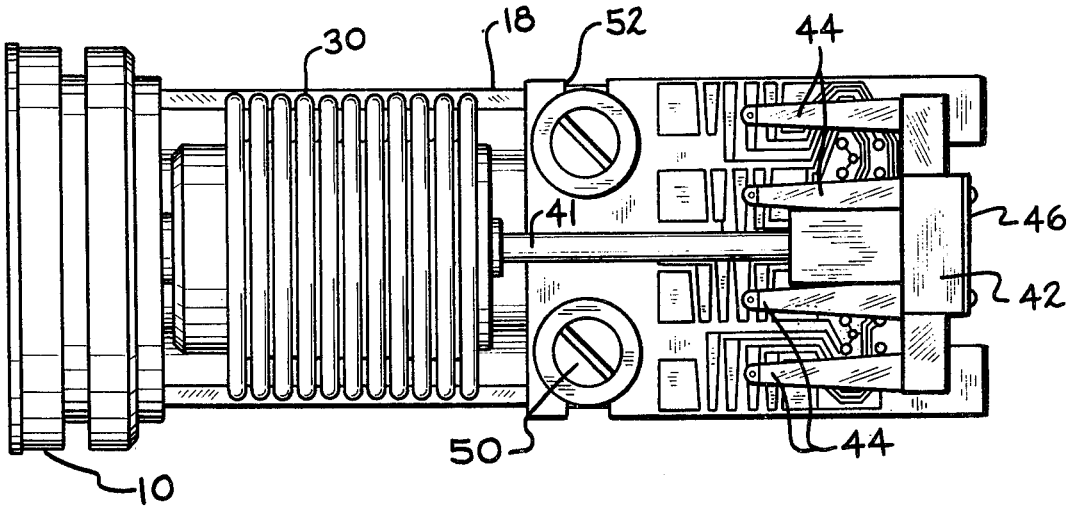
FIG. 3 is a top view of a transducer in accord with FIGS. 1 and 2, the casing being removed.

The printed circuit board 22 is mounted upon the support 18 by a pair of screws 50, FIG. 6, extending through notches 52 defined in the lateral edges of the printed circuit board. Loosening the screws 50 permits the printed circuit board to be moved laterally with respect to the length of the rod 41 and the direction of movement of the contact block as the bellows 30 expands and contracts. Tightening of the screws 50 will firmly affix the printed circuit board to the support 18.

Figure 7:
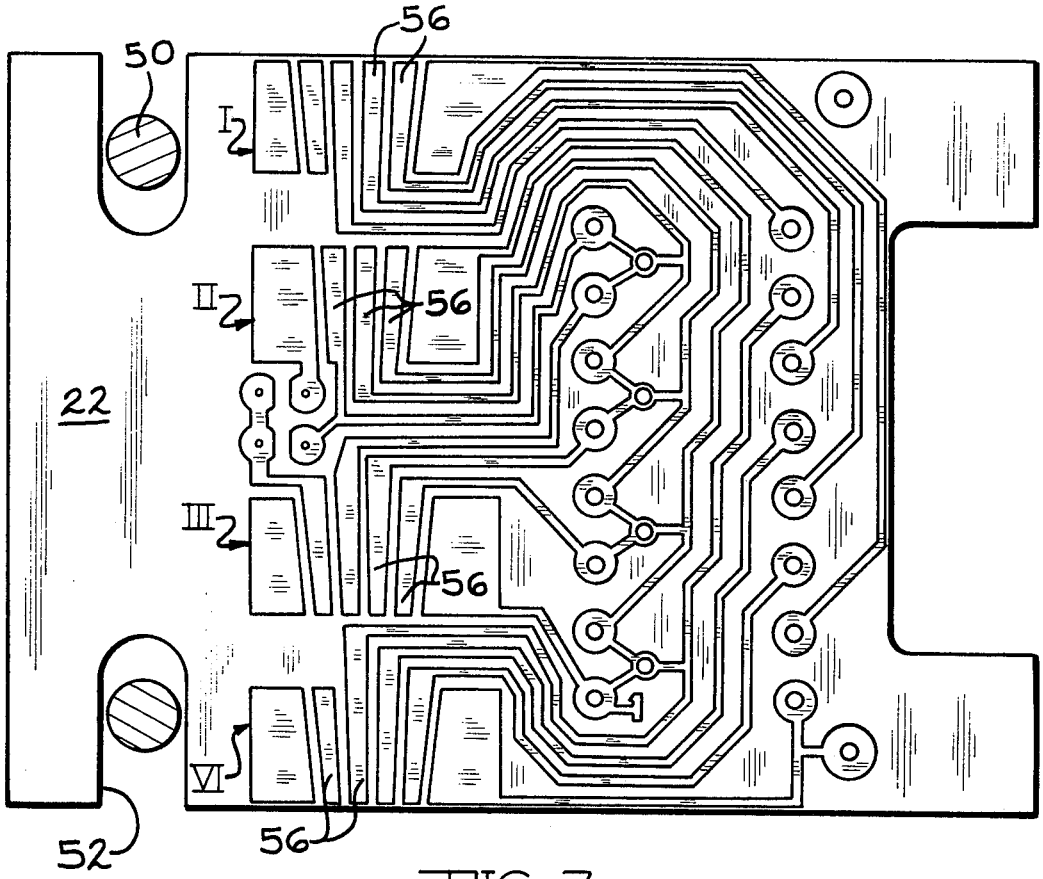
FIG. 7 is an enlarged plan view of the printed circuit board utilized in the embodiments of FIGS. 1–6.
Figure 4:
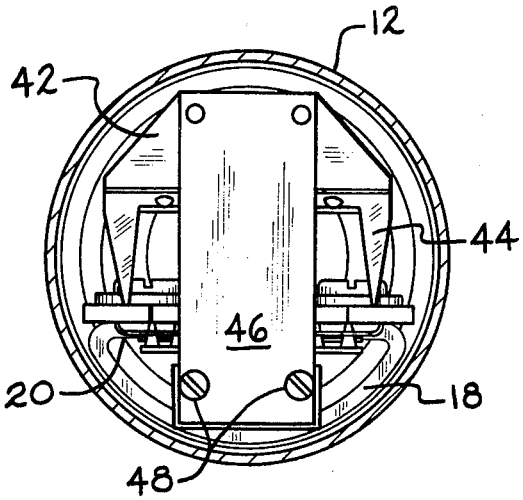
FIG. 4 is an end elevational sectional view as taken along section IV—IV of FIG. 2.
Figure 8:
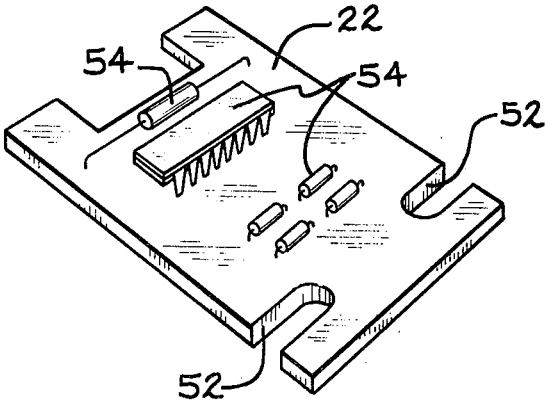
FIG. 8 is a perspective view of the underside of the printed circuit board shown in FIG. 7.

A typical configuration of the circuitry defined on the printed circuit board 22 will be apparent from FIG. 7. The conducting portions of the printed circuit over which the contacts 44 slide are arranged in four separate sets in view of the fact that four sliding contacts are being utilized. The sets are electrically interconnected to resistance members 54 mounted on the underside of the printed circuit board, FIG. 8, and the particular value of the resistances, and the arrangement of electrical connections between the conducting portions is a matter of choice and, in itself, does not constitute a portion of the inventive character of the invention.

Each set of conducting portions I, II, III and IV defined on the printed circuit board 22 includes a plurality of conducting portions 56, the majority of which are of a wedge configuration, as will be appreciated from FIG. 7. The wedge configuration results in a uniform varying dimension of the conducting portions in the lateral direction of the printed circuit board, i.e., at right angles to the direction of movement of the sliding contacts 44, and permits the dimension of the conducting portions traversed by the sliding contacts to be minutely varied as the printed circuit board 22 is laterally adjusted on its support 18. In this manner the "span," i.e., the dimension of the conducting portions 56 engaged by the contacts 44, may be varied to adjust the transducer for the particular sensitivity and range desired. In a typical arrangement each adjacent conducting portion of each set will produce a signal indicating a 0.5 psi variation, and the lateral adjustment of the printed circuit board in conjunction with the wedge configuration permits at most accurate calibration of the transducer.

Of course, calibration and initial setting of the transducer in accord with the initial pressure conditions is also achieved by adjustment of the screw 16, and a transducer constructed in accord with the aforedescribed relationships is capable of a great deal of flexibility because of the accurate adjustment features.

The embodiment of FIGS. 9 and 10 is directed to a "short"version of the transducer utilizing principles of the invention, and the shorter length, as compared with the previously described embodiment, is achieved by locating the electrical contacts in radical alignment with the bellows.

With reference to FIGS. 9 and 10, the casing 58 serves as a base and encompasses the operating structure of the transducer. The casing is provided with a removable end 60 which may be threaded or screwed to the left portion, FIG. 10, by threads or bolts, not shown, and the casing is provided with a thread opening 62 receiving the bushing 64 which is exteriorly and internally threaded. A threaded cap 66 is mounted upon the end of the bushing. The bellows 68 includes a base end having a threaded stud 70 which threads within the bushing 64, and a slot for receiving a screwdriver whereby rotation of the stud rotates the bellows and axially positions the bellows with respect to the casing.

The right tubular end of the bellows, FIG. 10, is provided with a recessed pocket 72 having a conical surface 74 defined therein which engages the contact block positioning pin 76.

The contact block 78 is mounted on a torsion spring bracket 80 which is, in turn, affixed to the printed circuit board support 82. The support 82 is attached to the bushing 64 and extends in a direction parallel to the axis of the bellows 68. The spring 80 maintains the spacing of the contact block from the printed circuit board 84, and biases the block toward the left, FIG. 10. The pin 76 is mounted upon the block and engages the surface 74 and is centered thereon by the conical configuration of the surface. Thus, the pin 76 will determine the axial relationship of the contact block 78 with respect to the bellows and the spring 80 will bias the pin into engagement with surface 74 and also determine the radial position of the contact block with respect to the bellows axis.

In the illustrated embodiment, two spring contacts 86 are mounted upon the contact block 78 for traversing the printed circuit board and making electrical contact with the conducting portions defined thereon.

A printed circuit board 84 mounted upon the support 82 includes a printed circuit of desired construction, preferably similar to that shown in FIG. 7, and the printed circuit board is attached to the support by a pair of screws 88, one of which is shown, extending through slots or notches 90 defined in the support and laterally extending so as to permit lateral adjustment of the printed circuit board relative to the support 82.

Adjustment of the contacts 86 with respect to the printed circuit board 84 is achieved by rotating the bellows stud 70. Rotation of the stud with a screwdriver will cause axial positioning of the bellows and the contact block 78 due to the spring bracket 80 maintained engagement between the bellows and the contact block through the contact block pin. The pointed end of the pin 76 permits rotation of the bellows relative to the contact block without producing torque forces or other undesired stresses on the contact block.

Operation of the transducer embodiment of FIGS. 9 and 10 is identical to that of the previously described embodiment wherein expansion and contraction of the bellows 68 causes the contacts 86 to traverse the conductive portions on the printed circuit board producing an electrical resistance proportional to the pressure imposed upon the bellows. Of course, a port, not shown, is defined in the casing 58 wherein the interior of the casing is exposed to the pressure being sensed. Further, electrical conductor, not shown, are connected to the resistances defined on the printed circuit board.

Another embodiment of transducer utilizing the inventive concepts of the invention is shown in FIGS. 12 through 15. In this embodiment the casing 92 is illustrated as including a plurality of ports for cooperating with fittings 94 and 96. The end of the casing is closed by a cover 98, which may be held in place by screws, not shown, and screw terminals 100 are mounted on the cover in electrical connection to the resistances defined on the printed circuit board.

The bellows 102 is maintained within the casing 92 upon a base 104 affixed to a threaded bushing 106 which is internally threaded for receiving the threaded printed circuit support adjustment screw 108. The adjustment screw 108 is provided with a slotted head exteriorly accessible upon removal of the threaded cap 110.

A pair of parallel cylindrical guide rods 112 are mounted in the base 104 on each side of bushing 106 extending parallel to the axis of the bellows 102, and the printed circuit board support 114, formed of a dielectric plastic material, is slidably supported upon the guide rods 112. A compression spring 118, encompassing the adjustment screw 108, biases the support 114 to the right and the screw is provided with a snap ring at its right end, FIG. 12, whereby the support 114 may be accurately translated in either direction of movement upon the rods 112 by rotation of the screw.

The printed circuit board 120 is mounted upon the support 114 for adjustment in a lateral direction by means of the screws 122 received in lateral extending notches 124 defined in the support.

Figure 1:
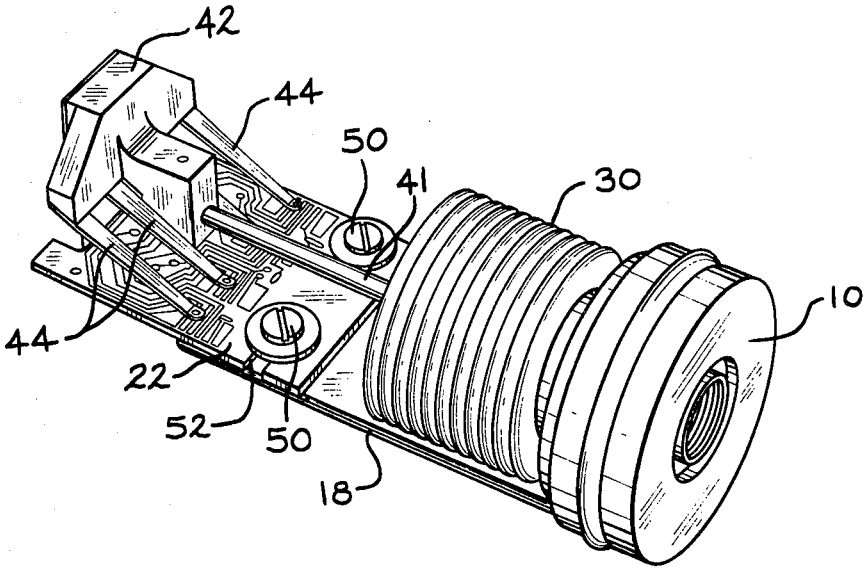
FIG. 1 is a perspective view of a transducer in accord with the ivention, without its casing, utilizing four sliding contacts.

The construction of the bellows 102 is similar to the bellows 30 described with respect to the embodiment of FIGS. 1 and 2, and the contact block 126 is mounted upon the rod 128 and maintained in predetermined spaced relationship to the printed cicuit board by the flexible left 130. The electrical contacts 132 engage the surface of the printed circuit board for traversing the conducting portions 134 and, in the disclosed embodiment of FIGS. 12 through 15, only two contacts are mounted upon the contact block and are sufficiently laterally spaced as to be located on either side of the bellows, as well be appreciated from FIGS. 12 and 14.

Initial calibration and orientation of the bellows 102 and printed circuit board 120 is achieved by rotating the screw 108 which moves the support 114 and printed circuit board under the contacts 132 and, in this manner, the transducer may be calibrated for the particular pressure being sensed. Of course, it is desired that the printed circuit board include the wedge-shaped conducting portions 134, FIG. 15, and the basic operating concepts of this embodiment are similar to the previously disclosed embodiments.

As transducers of this sliding contact type must be very accurately assembled in order to prevent erroneous readings, it is most important that the "axis" of the printed circuit board be parallel to the axis and direction of movement of the bellows during expansion and contraction. The "axis" of the printed circuit board is defined as the direction of the board in which the printed circuit conducting portion sets are oriented. For instance, with respect to FIGS. 7 and 11, the axis of the printed circuit board is horizontal as these figures are viewed since the contacts move to the left and right across the boards. In order to prevent inaccuracies, it is critical that the printed circuit board not be askewed or oblique to the direction of contact movement during sensing of pressures.

In that the printed circuit board of the transducer of the invention is laterally adjustable by means of the notches and mounting screws and as the notches are normally of a greater width than the diameter of the screws, it is possible to askew the printed circuit board with respect to the direction of contact movement. In practice, assembly of the printed circuit board upon its support is usually accomplished with a jig and fixture in order to maintain the proper orientation between the support and the printed circuit board, and to aid the assembler, the printed circuit board may be provided with a pair of reference points which electrically indicate the orientation of the printed circuit board to the electric contacts.

Figure 11:
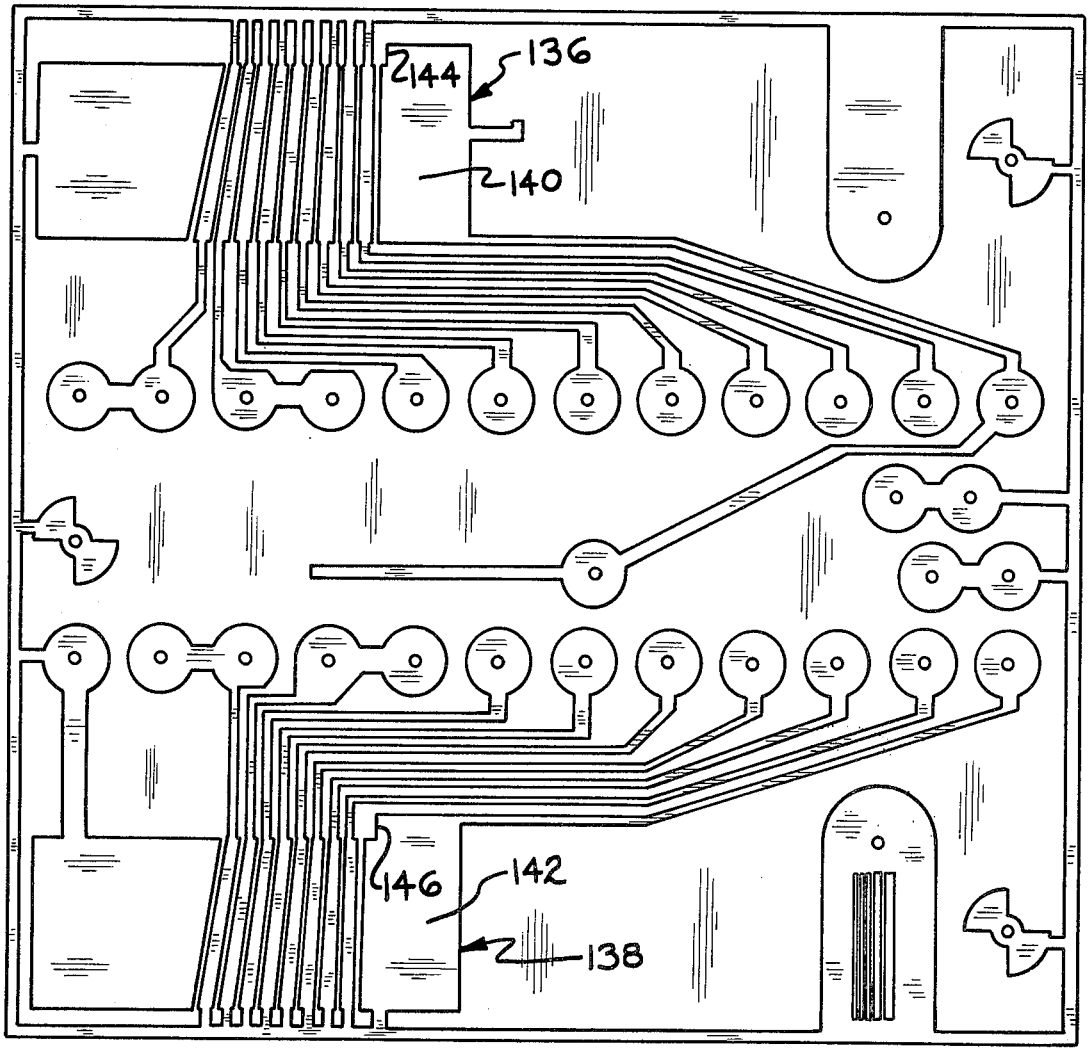
FIG. 11 is a plan view of a circuit board used with a two contact transducer illustrating the zero reference points.
Figure 12:
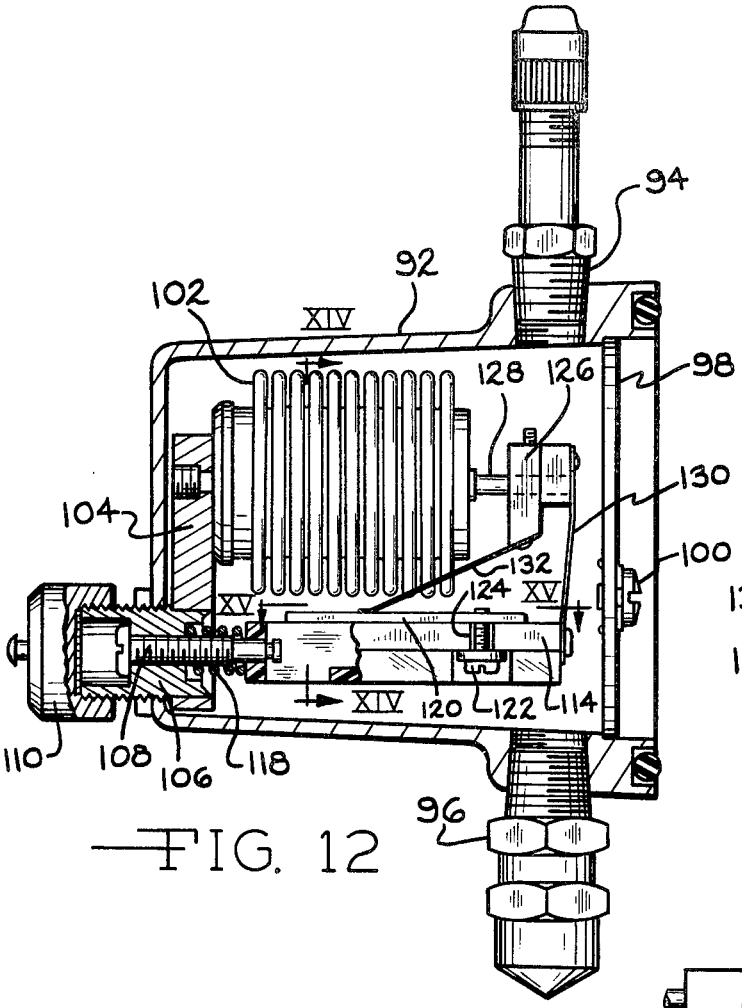
FIG. 12 is a sectional elevational view of another embodiment of transducer constructed in accord with the invention.
Figure 14:
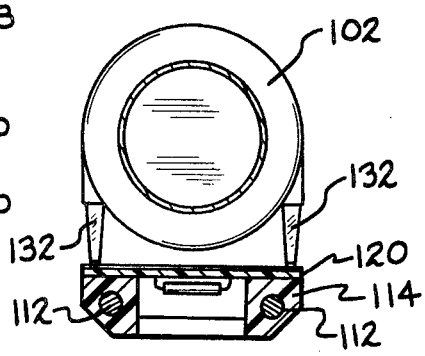
FIG. 14 is an elevational sectional view taken along section XIV—XIV of FIG. 12.
Figure 15:
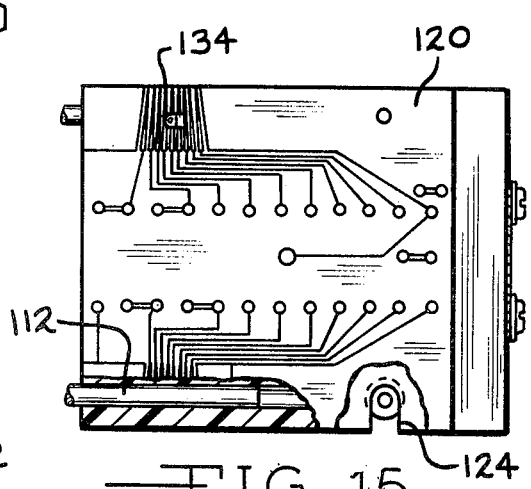
FIG. 15 is a plan view of the printed circuit board as taken along section XV—XV of FIG. 12.
Figure 13:
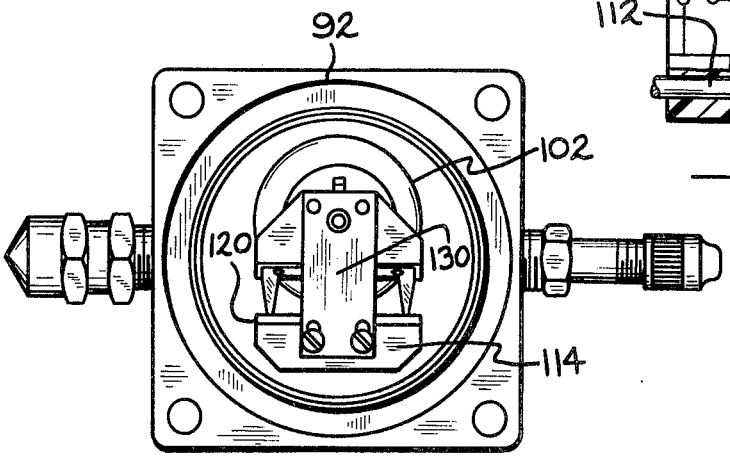
FIG. 13 is an end view of the transducer of FIG. 12, the transducer end plate being removed.

With reference to FIG. 11, a printed circuit board is illustrated having two sets of conducting portions 136 and 138 laterally spaced with respect to the direction of movement of the contacts, each set of conducting portions being engageable by a single electrical contact, as in the embodiment of FIGS. 12 through 15. The conducting portions 140 and 142 of each set are each provided with a reference edge 144 and 146, respectively, which is accurately located with respect to the "axis" of the printed circuit board and, thus, during initial assembly of the transducer components the printed circuit board is positioned upon its support such that the edges 144 and 146 are in engagement with the contact points defined upon the electrical contacts. Of course, as the portion of the printed circuit board upon which the conducting portions are located is dielectric it is possible to position the board upon its support so that the contacts barely engage the edges 144 and 146 and, by observing flow of current through the electrical resistance by readout apparatus when the contacts are being positioned relative to the reference edges 144 and 146, the printed circuit board can be very accurately located with respect to its support prior to tightening of the mounting screws.

Of course, when utilizing the reference points 144 and 146 it is necessary that the circuitry of the transducer be such as to be capable of sensing the position of two contacts relative to their associated reference edges as defined upon conducting portions 140 and 142. Thus, the reference edges are used with printed circuit boards usually having only two sets of conducting portions as used with two contacts, such as in the embodiment shown in FIGS. 12 through 14. However, the reference edges can be used with a four contact board if the sliding contacts are electrically separated so as to produce the desired electric signal to indicate the position of the printed circuit board upon its support.

It will be appreciated that the transducer of the invention is simple in manufacture and operation as no force magnifying levers or mechanisms are required since the contact block, and contacts, are directly operated by the bellows. While such direct driving of the contact block requires the printed circuit board to be very accurately located with respect to the bellows, the use of the wedge-shaped conducting portions, the mounting of the printed circuit board, and the use of the reference edge, permits the printed circuit board to be very precisely located upon its support, resulting in a highly accurate and practical transducer capable of sensing minute pressure variations.

It is appreciated that various modifications to the inventive concepts may be apparent to those skilled in the art without departing from the spirit and scope of the invention.

We claim:

1. A pressure transducer comprising, in combination, a base, a bellows having an axis, a longitudinally expandable and contractable wall, a support portion and a pressure responsive movable portion, bellows mounting means mounting said bellows support portion upon said base, a circuit board mounted upon said base having electrical conducting portions defined thereon, means mounting said circuit board on said base for adjustment transverse to said bellows axis, a contact block directly connected to said bellows pressure responsive portion for movement therewith, said contact block being in direct alignment with said bellows axis, means supporting said contact block on said base for liner movement in a direction parallel to said bellows axis. means producing relative movement between said bellows and said circuit board for adjusting the relative positions thereof, and at least one electrical contact mounted upon said contact block slidably engaging said circuit board conducting portions whereby movement of said bellows pressure responsive movable portion directly translates said contact over said circuit board portions, in a linear movement, and an electric circuit connected to said circuit board portions.

2. A pressure transducer as in claim 1 wherein said bellows mounting means and said means producing relative movement include a screw threaded into said base rotatably engaging said bellows support portion.

3. A pressure transducer as in claim 1 wherein said bellows mounting means and said means producing relative movement include a threaded stud coaxially fixed on said bellows support portion, and a threaded bore defined on said base receiving said stud.

4. A pressure transducer as in claim 1 wherein said means producing relative movement between said bellows and circuit board includes elongated guide means mounted upon said base parallel to said bellows axis, a circuit board support slidably mounted upon said guide means, and a screw interposed between said base and said circuit board support selectively adjusting said support relative to said base and said bellows.

5. A pressure transducer as in claim 4 wherein said guide means comprise a pair of parallel rods mounted upon said base, and bores defined in said circuit board support slidably receiving said rods.

6. A pressure transducer comprising, in combination, a base, pressure sensing means mounted upon said base having a contact block linearly movable in accord with the pressure being sensed, a circuit board mounted upon said base having electrical conducting portions defined thereon, at least one electrical contact mounted on said contact block engaging said circuit board movable across said conducting portions, at least some of said conducting portions being of a varying width in the direction parallel to the movable direction of said contact block and contact, and means adjustably mounting said circuit board upon said base permitting selective adjustment of said circuit board transverse to the direction of movement of said control block and contact for varying the extent of engagement between said contact and conducting portions for a predetermined movement of said electrical contact.

7. A pressure transducer as in claim 6 wherein said conducting portions having a varying width are of a wedge configuration having a uniformly varying width in the direction of movement of said contact block.

8. A pressure transducer as in claim 7 wherein said conducting portions defined on said circuit board include at least two sets of a plurality of conducting portions, a plurality of electrical contacts mounted on said contact block, a contact being associated with each set for engagement therewith, the wedge configuration of the conducting portions of each set converging in a common direction.

9. A pressure transducer comprising, in combination, a base, pressure sensing means mounted upon said base having a contact block linearly movable in accord with the pressure being sensed, a circuit board mounted upon said base having electrical conducting portions defined thereon, said electrical conducting portions including two portions laterally spaced from each other with respect to the direction of contact block movement, a pair of electrical contacts mounted upon said contact block laterally spaced with respect to each other to the direction of contact block movement and oriented to said contact block in a predetermined manner in the direction of contact block movement, said two portions each being slidably engaged by a contact, a reference point located on each of said two portions each oriented to said contacts in a predetermined manner in the direction of contact block movement and engageable by the associated contact at a predetermined position of said circuit board upon said base, electrical conductors connected to said two portions and said contacts, and means adjustably mounting said circuit board upon said base whereby the sensing of electrical contact between said reference points and said contacts electrically indicates the orientation of said circuit board to said base and said orientation is adjusted and maintained by said adjustable mounting means.

10. A pressure transducer as in claim 9 wherein said reference points are defined by an edge of said conducting portions.

11. A pressure transducer as in claim 9 wherein said adjustable mounting means include transversely defined notches formed in said circuit board, a circuit board support mounted on said base, and screws mounted on said support received within said notches.

* * * * *